US010861324B2

(12) United States Patent
Dingli

(10) Patent No.: US 10,861,324 B2
(45) Date of Patent: Dec. 8, 2020

(54) VEHICLE CABIN MONITORING

(71) Applicant: Pony AI Inc., Grand Cayman (KY)

(72) Inventor: Robert Dingli, Cupertino, CA (US)

(73) Assignee: Pony AI Inc., Grand Cayman (KY)

( * ) Notice: Subject to any disclaimer, the term of this patent is extended or adjusted under 35 U.S.C. 154(b) by 0 days.

(21) Appl. No.: 16/358,068

(22) Filed: Mar. 19, 2019

(65) Prior Publication Data

US 2020/0302779 A1 Sep. 24, 2020

(51) Int. Cl.
*G08C 19/00* (2006.01)

(52) U.S. Cl.
CPC ..... *G08C 19/00* (2013.01)

(58) Field of Classification Search
CPC .. G08C 19/00; G06F 3/0482; G06K 9/00664; G06K 9/00845
USPC ..... 340/3.1
See application file for complete search history.

(56) References Cited

U.S. PATENT DOCUMENTS 6,323,762 B1 * 11/2001 Ekpo, Jr. ..... B60R 25/305 340/426.35
6,542,076 B1 * 4/2003 Joao ..... B60R 25/33 340/539.14
8,098,142 B2 1/2012 Schofield et al.
8,352,118 B1 1/2013 Mittelsteadt et al.
9,843,777 B2 12/2017 Schofield et al.
9,926,148 B2 3/2018 Hochstein et al.
10,593,213 B1 * 3/2020 Copeland ..... H04L 63/0861
2003/0217882 A1 * 11/2003 Sakakida ..... B60R 22/24 180/268
2014/0379305 A1 * 12/2014 Kumar ..... G01V 11/00 702/190
2018/0111546 A1 * 4/2018 Salter ..... B60Q 3/20
2018/0211124 A1 * 7/2018 Rakah ..... G06Q 50/30
2018/0370543 A1 * 12/2018 Poeppel ..... B60W 50/12

FOREIGN PATENT DOCUMENTS

WO WO-2019152471 A2 * 8/2019 ..... G06F 21/00

* cited by examiner

*Primary Examiner* — Yong Hang Jiang

(74) *Attorney, Agent, or Firm* — Sheppard Mullin Richter & Hampton LLP

(57) ABSTRACT

Systems, methods, and non-transitory computer readable media may be configured to facilitate cabin monitoring of a vehicle. A selection of a cabin monitoring option may be monitored. Responsive to the selection of the cabin monitoring option, one or more sensors may be controlled to monitor an interior of a vehicle.

20 Claims, 6 Drawing Sheets

VEHICLE CABIN MONITORING

FIELD OF THE INVENTION

This disclosure relates to approaches for cabin monitoring of a vehicle.

BACKGROUND

Passengers riding in a vehicle (e.g., taxi, autonomous vehicle) may refuse in-cabin monitoring. Passengers may subsequently desire in-cabin monitoring. For example, a passenger in a ride-sharing vehicle may feel insecure when unknown passenger(s) enter the vehicle and may want in-cabin monitoring enabled.

SUMMARY

Various embodiments of the present disclosure may include systems, methods, and non-transitory computer readable media configured to facilitate cabin monitoring of a vehicle. A selection of a cabin monitoring option may be monitored. Responsive to the selection of the cabin monitoring option, one or more sensors may be controlled to monitor an interior of a vehicle.

In some embodiments, the selection of the cabin monitoring option may override a prior selection to disable an interior monitoring of the vehicle.

In some embodiments, the cabin monitoring option may be provided to an existing passenger responsive to a new passenger entering the vehicle. The interior monitoring of the vehicle may be disabled responsive to the new passenger or the existing passenger exiting the vehicle.

In some embodiments, the cabin monitoring option may be automatically selected for an existing passenger responsive to a new passenger entering the vehicle.

In some embodiments, the sensor(s) may include an image sensor and/or a sound sensor.

In some embodiments, the cabin monitoring option may be provided via a mobile device of a passenger.

In some embodiments, the cabin monitoring option may be provided via one or more controls on a door of the vehicle.

In some embodiments, the cabin monitoring option may be provided via one or more controls on a seatbelt system of the vehicle.

These and other features of the systems, methods, and non-transitory computer readable media disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for purposes of illustration and description only and are not intended as a definition of the limits of the invention.

BRIEF DESCRIPTION OF THE DRAWINGS

Certain features of various embodiments of the present technology are set forth with particularity in the appended claims. A better understanding of the features and advantages of the technology will be obtained by reference to the following detailed description that sets forth illustrative embodiments, in which the principles of the invention are utilized, and the accompanying drawings of which:

DETAILED DESCRIPTION

In various implementations, cabin of a vehicle may be monitored. A selection of a cabin monitoring option may be monitored. Responsive to the selection of the cabin monitoring option, one or more sensors, such as one or more image sensors and/or one or more sound sensors, may be controlled to monitor an interior of a vehicle.

The selection of the cabin monitoring option may override a prior selection to disable an interior monitoring of the vehicle. For example, an existing passenger in the vehicle may have previously selected to disable the interior monitoring of the vehicle, and the selection of the cabin monitoring option may override this prior selection.

The cabin monitoring option may be provided to an existing passenger responsive to a new passenger entering the vehicle. For example, when one or more additional passengers enter the vehicle, the existing passenger(s) may be provided with the cabin monitoring option.

The cabin monitoring option may be automatically selected for an existing passenger responsive to a new passenger entering the vehicle. For example, when one or more additional passengers enter the vehicle, the cabin monitoring option may automatically selected for existing passenger(s) within the vehicle.

The interior monitoring of the vehicle may be disabled responsive to the new passenger or the existing passenger exiting the vehicle. For example, an existing passenger may have selected the cabin monitoring option that was provided based on a new passenger entering the vehicle. When the new passenger or the existing passenger exits the vehicle, the interior monitoring of the vehicle may be automatically disabled. The interior monitoring of the vehicle may be disable at the moment the passenger exiting the vehicle or after a period of time after the passenger exits the vehicle.

The cabin monitoring option may be provided via one or more devices. For example, the cabin monitoring option may be provided via a mobile device of a passenger (e.g., via an app running on a smartphone or a tablet), one or more controls on a door of the vehicle (e.g., via one or more buttons/switches/dials/interfaces on a door), and/or one or more controls on a seatbelt system of the vehicle (e.g., via one or more buttons/switches/dials/interfaces on a seatbelt or a seatbelt buckle).

The approaches disclosed herein provides for monitoring cabin of a vehicle. When a passenger is inside a vehicle (e.g., taxi, ride-share vehicle, autonomous vehicle, personally-owned vehicle), the passenger and/or another entity (e.g., driver, organization operating the vehicle, owner of the vehicle) may wish to record activity within the vehicle for safety reasons. Monitoring the cabin of the vehicle may discourage passengers within the vehicle from acting inappropriately with respect to the vehicle, the driver, and/or other passengers. Monitoring the cabin of the vehicle may make one or more persons inside the vehicle feel more safe.

Figure 1:
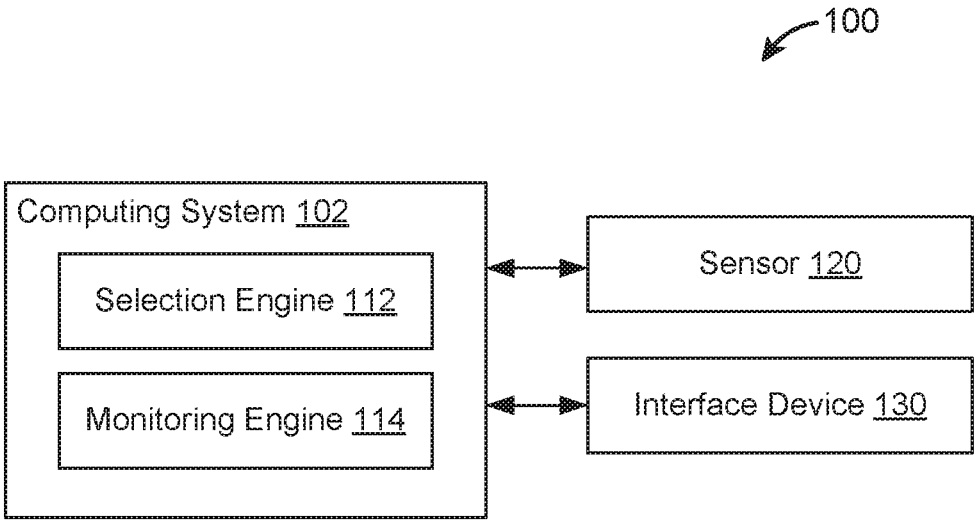
FIG. 1 illustrates an example environment for monitoring a cabin of a vehicle, in accordance with various embodiments.

FIG. 1 illustrates an example environment 100 for monitoring a cabin of a vehicle, in accordance with various embodiments. The example environment 100 may include a computing system 102, a sensor 120, and/or an interface device 130. The computing system 102 may be communicatively, electrically, and/or mechanically coupled to one or more other components of the environment 100. For example, the computing system 102 may be coupled to the sensor 120 and/or the interface device 130 to facilitate monitoring a cabin of a vehicle. The coupling between the different components within the environment 100 may include direct coupling and/or indirect coupling.

While components 102, 120, 130 of the environment 100 are shown in FIG. 1 as single entities, this is merely for ease of reference and is not meant to be limiting. For example, one or more components/functionalities of the computing system 102 described herein may be implemented, in whole or in part, within a single computing device or within multiple computing devices. The sensor 120 and/or the interface device 130 may include a single tool/component or multiple tools/components that provide functionalities described herein. For example, the sensor 120 may include a single sensor, multiple sensors of the same type, or different types of sensors. As another example, the interface device 130 may include one or more interface devices attached to a vehicle and/or one or more interface devices apart from the vehicle.

The sensor 120 may refer to a device that monitor (e.g., measure, ascertain, detect, estimate) one or more physical properties. A sensor may record, indicate, and/or otherwise respond to the measured physical propert(ies). For example, the sensor 120 may include one or more image sensor, one or more sound sensors, and/or other sensors. An image sensor may include a sensor (e.g., camera, sensor within a camera) that detects and/or conveys information that constitutes an image or a video. The image sensor may be configured to capture image(s) and/or video(s) of one or more persons (e.g., driver, passenger) inside the vehicle. The image(s) and/or video(s) of the person(s) may depict how the person(s) acted inside the vehicle. A sound sensor may include a sensor (e.g., microphone, sensor within a microphone) that detects and/or conveys information that constitutes sound or audio. The sound sensor may be configured to capture sound and/or audio of one or more persons (e.g., driver, passenger) inside the vehicle. The sound and/or audio of the person(s) may convey information on how the person(s) acted inside the vehicle. Use of other sensors are contemplated.

The sensor 120 may be positioned within, carried by, and/or affixed to a vehicle to monitor one or more physical properties within an interior of the vehicle. The interior of the vehicle monitored by the sensor 120 may include one or more portions of the cabin of the vehicle. The sensor 120 may monitor one or more persons within the vehicle. For example, the sensor 120 may monitor actions of one or more persons (e.g., driver, passenger) by using one or more image sensors to capture images and/or videos of the person(s). As another example, the sensor 120 may monitor actions of one or more persons (e.g., driver, passenger) by using one or more sound sensors to record sound and/or audio of the person(s). Monitoring of the interior of the vehicle by the sensor 120 may be used to perform one or more security functions for the vehicle.

The interface device 130 may refer to a device that enables a person to interact with the computing system 102 and/or one or more components of the computing system 102 (e.g., the selection engine 112, the monitoring engine 114). The interface device 130 may be a standalone device or part of another device. The interface device 130 may include one or more physical and/or virtual controls (e.g., buttons, switches, dials) that may be used by a person to interact with the computing system 102 and/or component(s) of the computing system 102. For example, the interface device 130 may include a physical button located inside a vehicle. A person may interact with the physical button (e.g., press, pull, move) to indicate to the computing system 102 the person's selection to enable or disable vehicle interior monitoring (e.g., via the sensor 120). As another example, the interface device 130 may include a mobile device of a person inside the vehicle or of a person about to enter the vehicle. An application running on the mobile device may allow a person to interact with a physical button on the mobile device and/or a virtual button presented on a touch-screen display of the mobile device to indicate to the computing system 102 the person's selection to enable or disable vehicle interior monitoring (e.g., via the sensor 120). Use of other interface devices are contemplated.

The computing system 102 may include one or more processors and memory. The processor(s) may be configured to perform various operations by interpreting machine-readable instructions stored in the memory. The environment 100 may also include one or more datastores that are accessible to the computing system 102 (e.g., stored in the memory of the computing system 102, coupled to the computing system, accessible via one or more network(s)). In some embodiments, the datastore(s) may include various databases, application functionalities, application/data packages, and/or other data that are available for download, installation, and/or execution. The computing system 102 may include a selection engine 112, a monitoring engine 114, and/or other engines.

In various embodiments, the selection engine 112 may be configured to monitor a selection of a cabin monitoring option. A cabin monitoring option may refer to an option to enable vehicle interior monitoring (e.g., via the sensor 120). Vehicle interior monitoring may include monitoring one or more portions of the cabin of the vehicle using the sensor 120. The selection engine 112 monitoring a selection of a cabin monitoring option may include the selection engine 112 determine whether and/or when a cabin monitoring option is selected. The selection engine 112 may monitor the cabin monitoring option to determine whether and/or when the cabin monitoring option is selected by a person (e.g., driver, passenger) or a computing device (e.g., automatic selection of the cabin monitoring option by the computing system 102). For example, the selection engine 112 may receive (directly or indirectly) from the interface device 130 one or more signals indicating a person's selection of the cabin monitoring option based on the person interacting with a control of the interface device 130. As another example, the selection engine 112 may monitor a flag that indicates whether the cabin monitoring option has been selected to determine whether and/or when the cabin monitoring option has been selected. Other monitoring of the selection of the cabin monitoring option are contemplated.

The cabin monitoring option may be provided via one or more devices, such as the interface device 130. The interface device 130 may be part of the vehicle or separate from the vehicle. For example, the cabin monitoring option may be provided via a mobile device of a passenger (e.g., via an app running on a smartphone or a tablet), one or more controls on a door of the vehicle (e.g., via one or more buttons/switches/dials/interfaces on a door), and/or one or more controls on a seatbelt system of the vehicle (e.g., via one or more buttons/switches/dials/interfaces on a seatbelt or a seatbelt buckle). A passenger may refer to a person who is or is about to travel on a vehicle. For example, the cabin monitoring option may be provided via a mobile device of a passenger who has recently entered the vehicle or is approaching the vehicle for a ride. Other provision of cabin monitoring option are contempered.

In some embodiments, the selection of the cabin monitoring option may override a prior selection to disable an interior monitoring of the vehicle. For example, an existing passenger in the vehicle may have previously selected to disable the interior monitoring of the vehicle, and the selection of the cabin monitoring option may override this prior selection.

In some embodiments, the cabin monitoring option may be provided to one or more existing passengers responsive to one or more new passengers entering the vehicle. For example, when one or more additional passengers enter the vehicle, the existing passenger(s) may be provided with the cabin monitoring option. The existing passenger(s) may have previously selected to disable the interior monitoring of the vehicle, and entry of the vehicle by additional passenger(s) may allow the existing passenger(s) to change their prior selection.

In some embodiments, the cabin monitoring option may be automatically selected for one or more existing passengers responsive to one or more new passengers entering the vehicle. That is, the cabin monitoring option may be automatically selected for existing passenger(s) of a vehicle responsive to new passenger(s) entering the vehicle. Such automatic selection of the cabin monitoring option may allow the passengers to be monitored without one of the passengers having to select the cabin monitoring option. Some passengers may feel awkward or uncomfortable about selecting the cabin monitoring option in front of the new passenger(s) and the automatic selection of the cabin monitoring option may allow passengers to avoid situations in which they are selecting the cabin monitoring option in front of other passenger(s).

In some embodiments, the automatically selection of the cabin monitoring option may override a prior selection to disable an interior monitoring of the vehicle. For example, an existing passenger in the vehicle may have previously selected to disable the interior monitoring of the vehicle. When one or more additional passengers enter the vehicle, the cabin monitoring option may automatically selected and override the prior selection to disable the interior monitoring of the vehicle.

In some embodiments, the cabin monitoring option may be provided to passengers before entry into the vehicle. For example, when a person requests a ride or the ride is near the person, the person may be provided with the cabin monitoring option (via a mobile device). As another example, when a new passenger is to enter the vehicle, one or more passengers inside the vehicle may be provided with the cabin monitoring option before the new passenger enters the vehicle.

In some embodiment, there may be conflicting selection of the cabin monitoring option. For example, one or more passengers of a vehicle may have selected to enable interior monitoring of the vehicle while one or more other passengers of the vehicle may have selected to disable interior monitoring of the vehicle. Conflicting selection of the cabin monitoring option may be resolved in favor of either interior monitoring of the vehicle or non-interior monitoring of the vehicle. For example, based on at least one passenger having selected in favor of interior monitoring of the vehicle, the interior monitoring of the vehicle may be enabled regardless of the number of other passengers who selected to disable interior monitoring of the vehicle. As another example, the interior monitoring of the vehicle may be enabled based on at least the same number of passengers or based on a greater number of passengers having selected in favor of interior monitoring of the vehicle compared to the number of passengers having selected to disable interior monitoring of the vehicle.

In various embodiments, the monitoring engine 114 may be configured to, responsive to a selection of a cabin monitoring option, control one or more sensors to monitor an interior of a vehicle. For example, the monitoring engine 114 may control the sensor 120 (e.g., one or more image sensors, one or more sound sensors) to monitor an interior of a vehicle. The interior of the vehicle may include one or more portions of the cabin of the vehicle. For example, the monitoring engine 114 may control (directly or indirectly) a camera to capture image(s) and/or video(s) of one or more persons (e.g., driver, passenger) inside the vehicle. As another example, the monitoring engine 114 may control (directly or indirectly) a microphone to capture sound and/or audio of one or more persons (e.g., driver, passenger) inside the vehicle.

The monitoring engine 114 may control the sensor 120 by one or more of turning on the sensor 120, selecting a particular mode in which the sensor 120 is operating, directing how the sensor 120 is to operate, and/or otherwise controlling the sensor 120. For example, responsive to a selection of a cabin monitoring option, the monitoring engine 114 may turn on a camera and/or a microphone to record activity within the cabin, select a mode of operation for the camera and/or the microphone (e.g., switch from temporary recording of activity within the cabin to permanent recording of activity within the cabin, change the rate of recording of activity within the cabin), and/or direct how the camera and/or the microphone operates to record activity within the cabin (e.g., based on activity detected within the cabin, change zoom and/or direction in which the camera is pointed and/or change sensitivity of the microphone).

Content captured by the sensor 120 may be used to monitor activity within the vehicle. For example, image(s), video(s), audio, and/or sound captured by the sensor 120 may be used to monitor actions of one or more persons inside the vehicle. As another example, image(s), video(s), audio, and/or sound captured by the sensor 120 may be used to perform one or more security functions (e.g., confirming that passengers are safe, determining whether an illegal activity is occurring within the vehicle, detecting vandalism of the vehicle) for the vehicle.

The monitoring engine 114 may be configured to control one or more sensors to disable interior monitoring of the vehicle. Disabling interior monitoring of the vehicle may include one or more of turning off the sensor 120, selecting a particular mode in which the sensor 120 is operating (e.g., switch from permanent recording of activity within the cabin to temporary recording of activity within the cabin, change the rate of recording of activity within the cabin), directing how the sensor 120 is to operate (e.g., no change in operation based on activity within the cabin), and/or otherwise controlling the sensor 120. The monitoring engine 114 may disable interior monitoring of the vehicle based on a user selection. For example, a passenger may have initially selected in favor of interior monitoring of the vehicle and later selected to disable interior monitoring of the vehicle, and the monitoring engine 114 may disable interior monitoring of the vehicle. As another example, interior monitoring of the vehicle may have been enabled in response to one or more new passengers entering the vehicle, and interior monitoring of the vehicle may be disable responsive to the new passenger(s) or existing passenger(s) exiting the vehicle. For example, an existing passenger may have selected the cabin monitoring option that was provided based on a new passenger entering the vehicle. When the new passenger or the existing passenger exits the vehicle, the interior monitoring of the vehicle may be automatically disabled. The interior monitoring of the vehicle may be disable at the moment the passenger exiting the vehicle or after a period of time after the passenger exits the vehicle.

Figure 2:
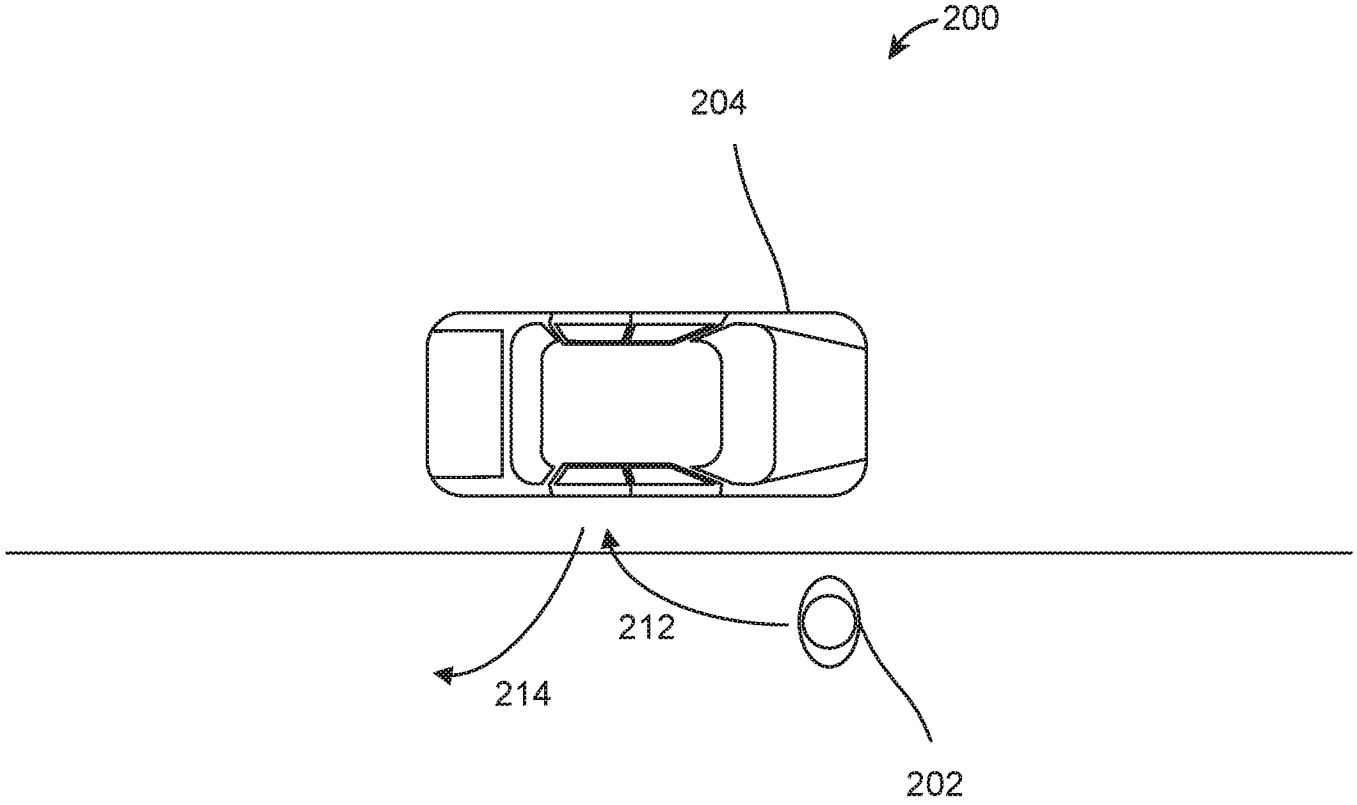
FIG. 2 illustrates an example environment for monitoring a cabin of a vehicle, in accordance with various embodiments.

FIG. 2 illustrates an example environment 200 for monitoring a cabin of a vehicle, in accordance with various embodiments. The environment 200 may include a passenger 202 and a vehicle 204. The passenger may enter 212 the vehicle 204 or exit the vehicle 214. The passenger 202 may be provided with a cabin monitoring option based on entry 212 into the vehicle 204. For example, before the passenger 202 enters 212 the vehicle 204, a mobile device of the passenger 202 may prompt the passenger 202 to select an option to enable or disable monitoring of the cabin of the vehicle 204. After the passenger 202 enters 212 the vehicle 204, the passenger 202 may use the mobile device or other interface device(s) within the vehicle 204 to enable or disable monitoring of the cabin of the vehicle 204. When the passenger exits 214 the vehicle, monitoring of the cabin of the vehicle 204 may be disabled.

The entry 212 of the passenger 202 may allow existing passenger(s) inside the vehicle 204 to enable monitoring of the cabin of the vehicle 204. For example, the vehicle 204 may include an existing passenger. The existing passenger may have previously selected to disable monitoring of the cabin of the vehicle 204. Based on the entry 212 of the passenger 202 into the vehicle 204 (e.g., before the entry 212, after the entry 212), the existing passenger may be prompted to enable monitoring of the cabin of the vehicle 204 (and override the prior selection to disable monitoring of the cabin of the vehicle 204). The monitoring of the cabin of the vehicle 204 may be automatically enable based on the vehicle 204 including one or more existing passengers and the entry 212 of the passenger 202 into the vehicle 204. When the existing passenger(s) and/or the passenger 202 exits 214 the vehicle, the monitoring of the cabin of the vehicle 204 may be automatically disabled.

Figure 3:
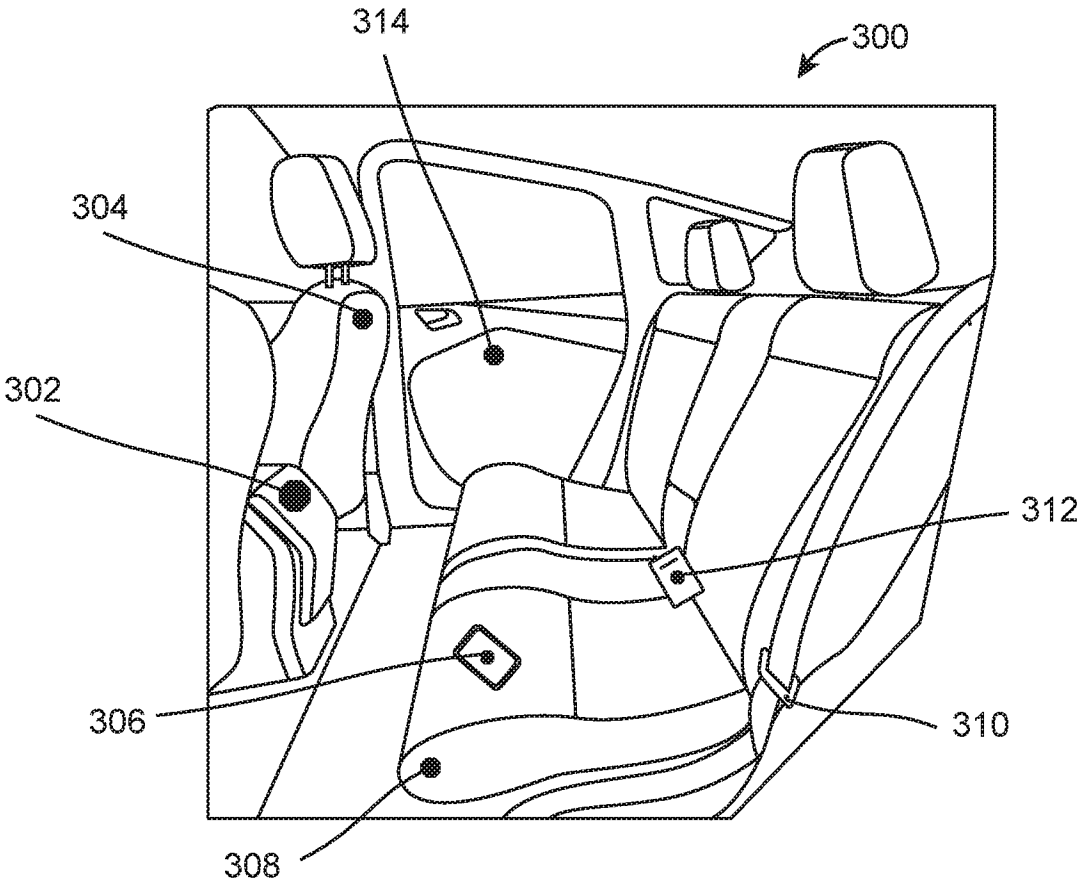
FIG. 3 illustrates an example environment for monitoring a cabin of a vehicle, in accordance with various embodiments.

FIG. 3 illustrates an example environment 300 for monitoring a cabin of a vehicle, in accordance with various embodiments. The environment 300 may include a cabin of a vehicle with multiple controls 302, 304, 306, 308, 310, 312, 314 with which a passenger may interact to enable vehicle interior monitoring. The controls 302, 304, 306, 308, 310, 312, 314 may be provided for easy reach of passenger(s) inside the vehicle. The passenger may interact with one or more of the controls 302, 304, 306, 308, 310, 312, 314 to select a cabin monitoring option. The controls 302, 304, 306, 308, 310, 312, 314 may include physical controls or virtual controls. For example, the control 302 may include a physical control (e.g., button, switch, dial, interface) on a center console of the vehicle. The control 302 may include a physical control on the back of a front seat of the vehicle. The control 306 may include a virtual control displayed on a mobile device of a passenger. The control 308 may include a physical control on the side of a back seat of the vehicle. The control 310 may include a physical control on a seat belt tongue (e.g., housing of the seat belt male connector) of the vehicle. The control 312 may include a physical control on a seat belt buckle (e.g., housing of the seat belt female connector) of the vehicle. The control 314 may include a physical control on a door (e.g., on a door handle, on an arm rest, on a door panel, on a door control interface) of the vehicle. Other types of controls and other placement of controls are contemplated.

Conspicuous provision of the cabin monitoring option may enable a passenger to enable vehicle interior monitoring in a way that is noticeable to other persons (e.g., driver, passenger) inside the vehicle. For example, provision of the cabin monitoring option via the controls 302, 304 may enable a person inside the vehicle to enable vehicle interior monitoring in a way that is noticeable to other person(s) inside the vehicle. Inconspicuous provision of the cabin monitoring option may enable a passenger to enable vehicle interior monitoring in a way that is not noticeable to other persons inside the vehicle. For example, provision of the cabin monitoring option via the control 308, 310, 312, 314 may enable a person inside the vehicle to enable vehicle interior monitoring in a way that is not noticeable to other person(s) inside the vehicle. A person's use of the control 306 to enable vehicle interior monitoring may be conspicuous or inconspicuous, depending on how the person uses the mobile phone on which the control 306 is displayed.

Status of vehicle interior monitoring (whether vehicle interior monitoring is enabled or disabled) may be presented conspicuously or inconspicuously. For example, the vehicle may include a status light or a display that presents visual information on whether the vehicle interior monitoring is enabled or disabled. As another example, one or more speakers of the vehicle may be used to audibly provide information on the status of the vehicle interior monitoring (e.g., audible notice that the vehicle interior monitoring has started, is enabled, or has been disabled). As yet another example, the status of the vehicle interior monitoring may be presented on a mobile device of a passenger. For instance, a user may use the control 306 to silently turn on vehicle interior monitoring.

Figure 4A:
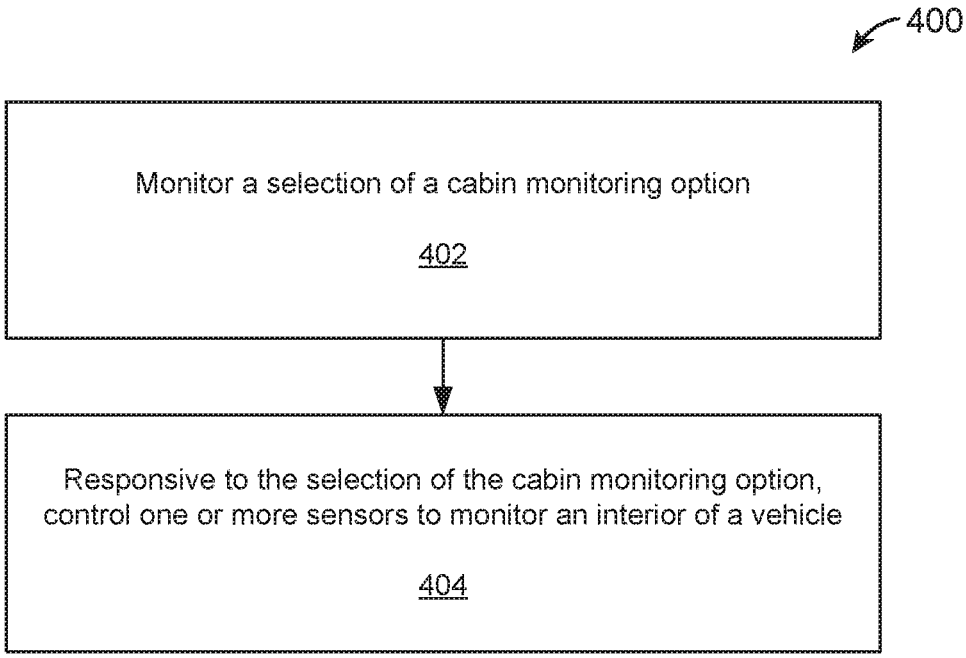
FIG. 4A illustrates a flowchart of an example method, in accordance with various embodiments.

FIG. 4A illustrates a flowchart of an example method 400, according to various embodiments of the present disclosure. The method 400 may be implemented in various environments including, for example, the environment 100 of FIG. 1. The operations of method 400 presented below are intended to be illustrative. Depending on the implementation, the example method 400 may include additional, fewer, or alternative steps performed in various orders or in parallel. The example method 400 may be implemented in various computing systems or devices including one or more processors.

At block 402, a selection of a cabin monitoring option may be monitored. At block 404, responsive to the selection of the cabin monitoring option, one or more sensors may be controlled to monitor an interior of a vehicle.

Figure 4B:
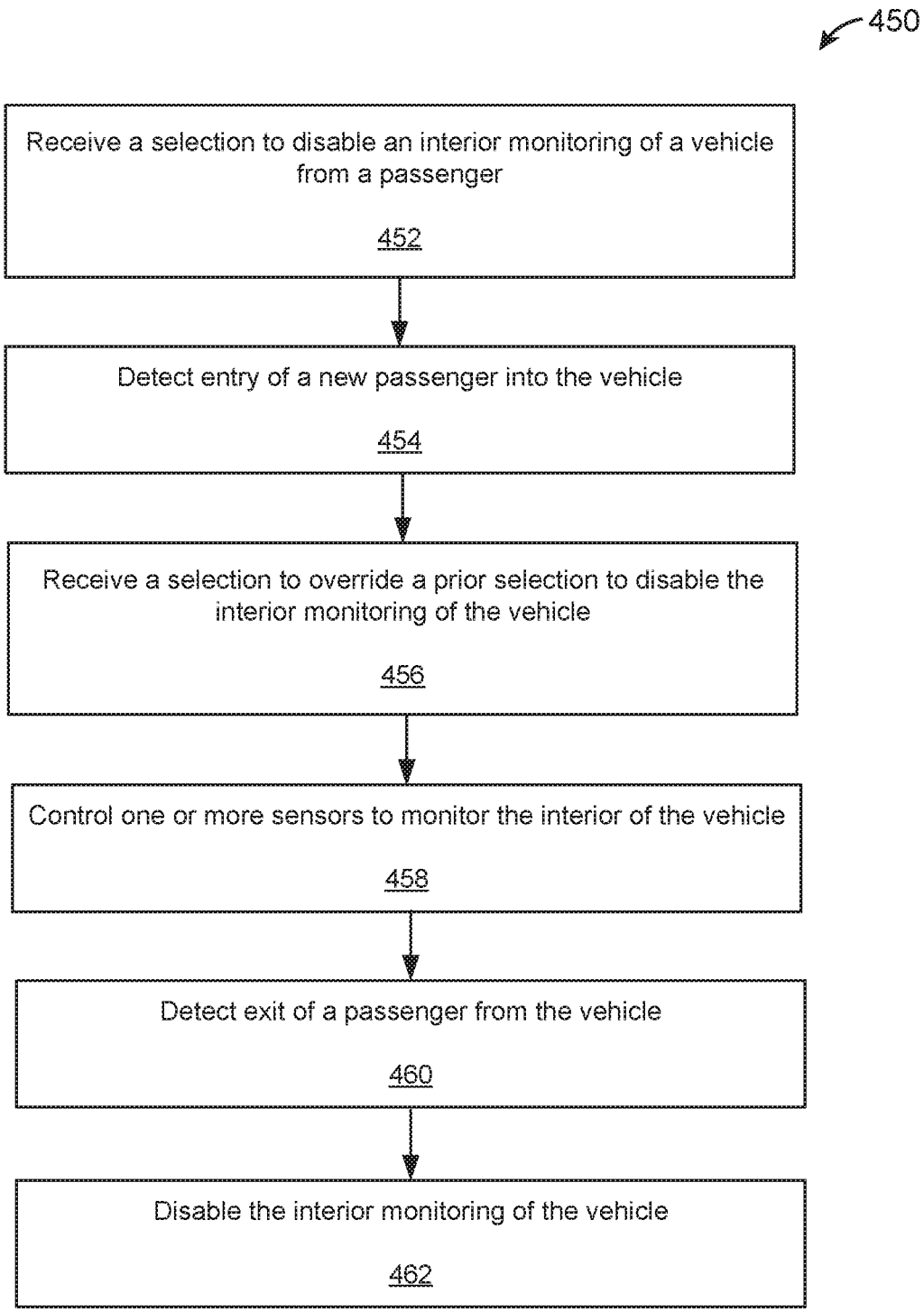
FIG. 4B illustrates a flowchart of another example method, in accordance with various embodiments.

FIG. 4B illustrates a flowchart of an example method 450, according to various embodiments of the present disclosure. The method 450 may be implemented in various environments including, for example, the environment 100 of FIG. 1. The operations of method 450 presented below are intended to be illustrative. Depending on the implementation, the example method 450 may include additional, fewer, or alternative steps performed in various orders or in parallel. The example method 450 may be implemented in various computing systems or devices including one or more processors.

At block 452, a selection to disable an interior monitoring of a vehicle from a passenger may be received. At block 454, entry of a new passenger into the vehicle may be detected. At block 456, a selection to override a prior selection to disable the interior monitoring of the vehicle may be received. At block 458, one or more sensors may be controlled to monitor the interior of the vehicle. At block 460, exit of a passenger (existing passenger, new passenger) from the vehicle may be detected. At bock 462, the interior monitoring of the vehicle may be disabled.

Hardware Implementation

The techniques described herein are implemented by one or more special-purpose computing devices. The special-purpose computing devices may be hard-wired to perform the techniques, or may include circuitry or digital electronic devices such as one or more application-specific integrated circuits (ASICs) or field programmable gate arrays (FPGAs) that are persistently programmed to perform the techniques, or may include one or more hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, server computer systems, portable computer systems, handheld devices, networking devices or any other device or combination of devices that incorporate hard-wired and/or program logic to implement the techniques.

Computing device(s) are generally controlled and coordinated by operating system software, such as iOS, Android, Chrome OS, Windows XP, Windows Vista, Windows 7, Windows 8, Windows Server, Windows CE, Unix, Linux, SunOS, Solaris, iOS, Blackberry OS, VxWorks, or other compatible operating systems. In other embodiments, the computing device may be controlled by a proprietary operating system. Conventional operating systems control and schedule computer processes for execution, perform memory management, provide file system, networking, I/O services, and provide a user interface functionality, such as a graphical user interface ("GUI"), among other things.

Figure 5:
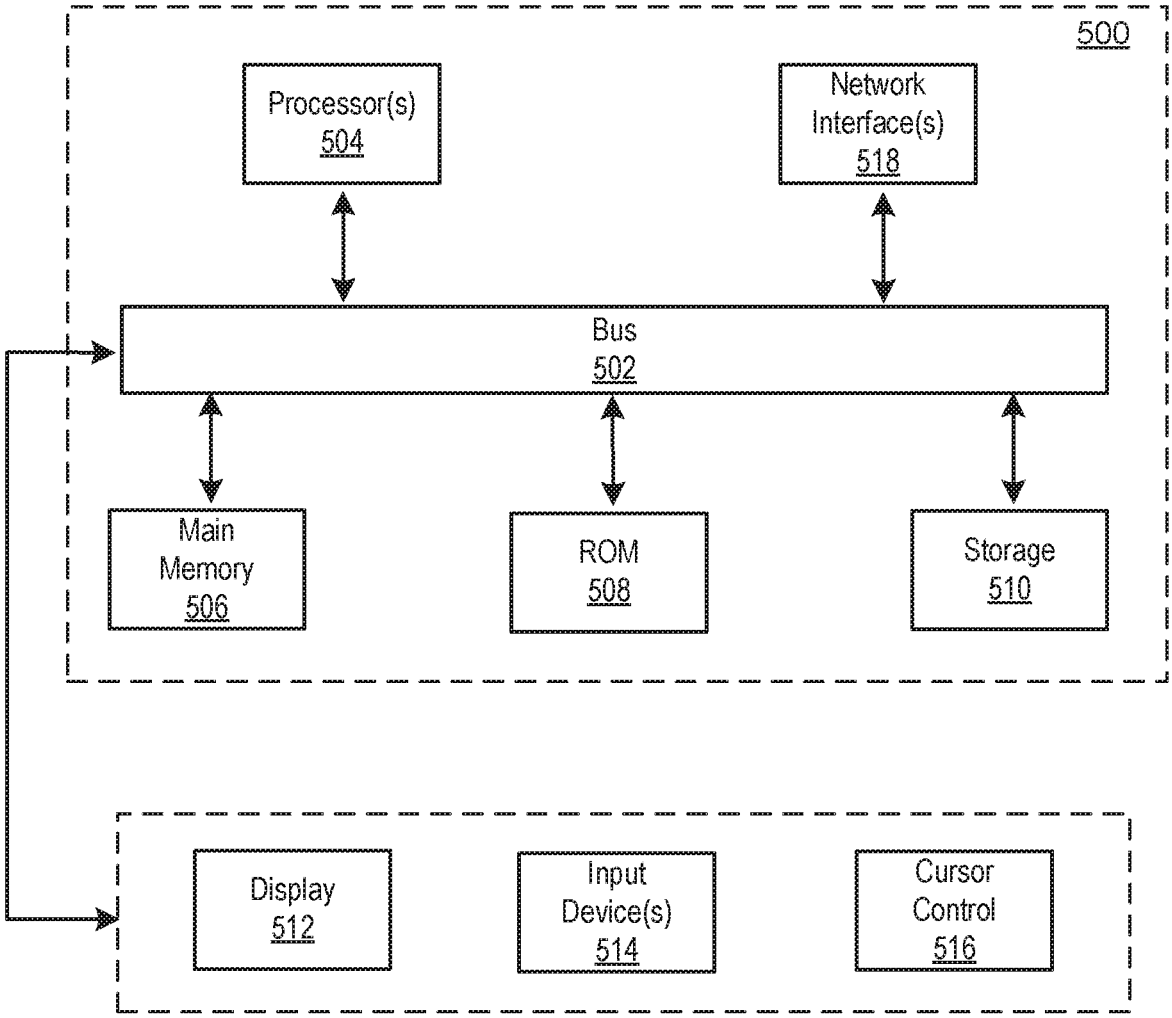
FIG. 5 illustrates a block diagram of an example computer system in which any of the embodiments described herein may be implemented.

FIG. 5 is a block diagram that illustrates a computer system 500 upon which any of the embodiments described herein may be implemented. The computer system 500 includes a bus 502 or other communication mechanism for communicating information, one or more hardware processors 504 coupled with bus 502 for processing information. Hardware processor(s) 504 may be, for example, one or more general purpose microprocessors.

The computer system 500 also includes a main memory 506, such as a random access memory (RAM), cache and/or other dynamic storage devices, coupled to bus 502 for storing information and instructions to be executed by processor 504. Main memory 506 also may be used for storing temporary variables or other intermediate information during execution of instructions to be executed by processor 504. Such instructions, when stored in storage media accessible to processor 504, render computer system 500 into a special-purpose machine that is customized to perform the operations specified in the instructions.

The computer system 500 further includes a read only memory (ROM) 508 or other static storage device coupled to bus 502 for storing static information and instructions for processor 504. A storage device 510, such as a magnetic disk, optical disk, or USB thumb drive (Flash drive), etc., is provided and coupled to bus 502 for storing information and instructions.

The computer system 500 may be coupled via bus 502 to a display 512, such as a cathode ray tube (CRT) or LCD display (or touch screen), for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. This input device typically has two degrees of freedom in two axes, a first axis (e.g., x) and a second axis (e.g., y), that allows the device to specify positions in a plane. In some embodiments, the same direction information and command selections as cursor control may be implemented via receiving touches on a touch screen without a cursor.

The computing system 500 may include a user interface module to implement a GUI that may be stored in a mass storage device as executable software codes that are executed by the computing device(s). This and other modules may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables.

In general, the word "module," as used herein, refers to logic embodied in hardware or firmware, or to a collection of software instructions, possibly having entry and exit points, written in a programming language, such as, for example, Java, C or C++. A software module may be compiled and linked into an executable program, installed in a dynamic link library, or may be written in an interpreted programming language such as, for example, BASIC, Perl, or Python. It will be appreciated that software modules may be callable from other modules or from themselves, and/or may be invoked in response to detected events or interrupts. Software modules configured for execution on computing devices may be provided on a computer readable medium, such as a compact disc, digital video disc, flash drive, magnetic disc, or any other tangible medium, or as a digital download (and may be originally stored in a compressed or installable format that requires installation, decompression or decryption prior to execution). Such software code may be stored, partially or fully, on a memory device of the executing computing device, for execution by the computing device. Software instructions may be embedded in firmware, such as an EPROM. It will be further appreciated that hardware modules may be comprised of connected logic units, such as gates and flip-flops, and/or may be comprised of programmable units, such as programmable gate arrays or processors. The modules or computing device functionality described herein are preferably implemented as software modules, but may be represented in hardware or firmware. Generally, the modules described herein refer to logical modules that may be combined with other modules or divided into sub-modules despite their physical organization or storage.

The computer system 500 may implement the techniques described herein using customized hard-wired logic, one or more ASICs or FPGAs, firmware and/or program logic which in combination with the computer system causes or programs computer system 500 to be a special-purpose machine. According to one embodiment, the techniques herein are performed by computer system 500 in response to processor(s) 504 executing one or more sequences of one or more instructions contained in main memory 506. Such instructions may be read into main memory 506 from another storage medium, such as storage device 510. Execution of the sequences of instructions contained in main memory 506 causes processor(s) 504 to perform the process steps described herein. In alternative embodiments, hard-wired circuitry may be used in place of or in combination with software instructions.

The term "non-transitory media," and similar terms, as used herein refers to any media that store data and/or instructions that cause a machine to operate in a specific fashion. Such non-transitory media may comprise non-volatile media and/or volatile media. Non-volatile media includes, for example, optical or magnetic disks, such as storage device 510. Volatile media includes dynamic memory, such as main memory 506. Common forms of non-transitory media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge, and networked versions of the same.

Non-transitory media is distinct from but may be used in conjunction with transmission media. Transmission media participates in transferring information between non-transitory media. For example, transmission media includes coaxial cables, copper wire and fiber optics, including the wires that comprise bus 502. Transmission media can also take the form of acoustic or light waves, such as those generated during radio-wave and infra-red data communications.

Various forms of media may be involved in carrying one or more sequences of one or more instructions to processor 504 for execution. For example, the instructions may initially be carried on a magnetic disk or solid state drive of a remote computer. The remote computer can load the instructions into its dynamic memory and send the instructions over a telephone line using a modem. A modem local to computer system 500 can receive the data on the telephone line and use an infra-red transmitter to convert the data to an infra-red signal. An infra-red detector can receive the data carried in the infra-red signal and appropriate circuitry can place the data on bus 502. Bus 502 carries the data to main memory 506, from which processor 504 retrieves and executes the instructions. The instructions received by main memory 506 may retrieves and executes the instructions. The instructions received by main memory 506 may optionally be stored on storage device 510 either before or after execution by processor 504.

The computer system 500 also includes a communication interface 518 coupled to bus 502. Communication interface 518 provides a two-way data communication coupling to one or more network links that are connected to one or more local networks. For example, communication interface 518 may be an integrated services digital network (ISDN) card, cable modem, satellite modem, or a modem to provide a data communication connection to a corresponding type of telephone line. As another example, communication interface 518 may be a local area network (LAN) card to provide a data communication connection to a compatible LAN (or WAN component to communicated with a WAN). Wireless links may also be implemented. In any such implementation, communication interface 518 sends and receives electrical, electromagnetic or optical signals that carry digital data streams representing various types of information.

A network link typically provides data communication through one or more networks to other data devices. For example, a network link may provide a connection through local network to a host computer or to data equipment operated by an Internet Service Provider (ISP). The ISP in turn provides data communication services through the world wide packet data communication network now commonly referred to as the "Internet". Local network and Internet both use electrical, electromagnetic or optical signals that carry digital data streams. The signals through the various networks and the signals on network link and through communication interface 518, which carry the digital data to and from computer system 500, are example forms of transmission media.

The computer system 500 can send messages and receive data, including program code, through the network(s), network link and communication interface 518. In the Internet example, a server might transmit a requested code for an application program through the Internet, the ISP, the local network and the communication interface 518.

The received code may be executed by processor 504 as it is received, and/or stored in storage device 510, or other non-volatile storage for later execution.

Each of the processes, methods, and algorithms described in the preceding sections may be embodied in, and fully or partially automated by, code modules executed by one or more computer systems or computer processors comprising computer hardware. The processes and algorithms may be implemented partially or wholly in application-specific circuitry.

The various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Any process descriptions, elements, or blocks in the flow diagrams described herein and/or depicted in the attached figures should be understood as potentially representing modules, segments, or portions of code which include one or more executable instructions for implementing specific logical functions or steps in the process. Alternate implementations are included within the scope of the embodiments described herein in which elements or functions may be deleted, executed out of order from that shown or discussed, including substantially concurrently or in reverse order, depending on the functionality involved, as would be understood by those skilled in the art.

It should be emphasized that many variations and modifications may be made to the above-described embodiments, the elements of which are to be understood as being among other acceptable examples. All such modifications and variations are intended to be included herein within the scope of this disclosure. The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

Engines, Components, and Logic

Certain embodiments are described herein as including logic or a number of components, engines, or mechanisms. Engines may constitute either software engines (e.g., code embodied on a machine-readable medium) or hardware engines. A "hardware engine" is a tangible unit capable of performing certain operations and may be configured or arranged in a certain physical manner. In various example embodiments, one or more computer systems (e.g., a standalone computer system, a client computer system, or a server computer system) or one or more hardware engines of a computer system (e.g., a processor or a group of processors) may be configured by software (e.g., an application or application portion) as a hardware engine that operates to perform certain operations as described herein.

In some embodiments, a hardware engine may be implemented mechanically, electronically, or any suitable combination thereof. For example, a hardware engine may include dedicated circuitry or logic that is permanently configured to perform certain operations. For example, a hardware engine may be a special-purpose processor, such as a Field-Programmable Gate Array (FPGA) or an Application Specific Integrated Circuit (ASIC). A hardware engine may also include programmable logic or circuitry that is temporarily configured by software to perform certain operations. For example, a hardware engine may include software executed by a general-purpose processor or other programmable processor. Once configured by such software, hardware engines become specific machines (or specific components of a machine) uniquely tailored to perform the configured functions and are no longer general-purpose processors. It will be appreciated that the decision to implement a hardware engine mechanically, in dedicated and permanently configured circuitry, or in temporarily configured circuitry (e.g., configured by software) may be driven by cost and time considerations.

Accordingly, the phrase "hardware engine" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented engine" refers to a hardware engine. Considering embodiments in which hardware engines are temporarily configured (e.g., programmed), each of the hardware engines need not be configured or instantiated at any one instance in time. For example, where a hardware engine comprises a general-purpose processor configured by software to become a special-purpose processor, the general-purpose processor may be configured as respectively different special-purpose processors (e.g., comprising different hardware engines) at different times. Software accordingly configures a particular processor or processors, for example, to constitute a particular hardware engine at one instance of time and to constitute a different hardware engine at a different instance of time.

Hardware engines can provide information to, and receive information from, other hardware engines. Accordingly, the described hardware engines may be regarded as being communicatively coupled. Where multiple hardware engines exist contemporaneously, communications may be achieved through signal transmission (e.g., over appropriate circuits and buses) between or among two or more of the hardware engines. In embodiments in which multiple hardware engines are configured or instantiated at different times, communications between such hardware engines may be achieved, for example, through the storage and retrieval of information in memory structures to which the multiple hardware engines have access. For example, one hardware engine may perform an operation and store the output of that operation in a memory device to which it is communicatively coupled. A further hardware engine may then, at a later time, access the memory device to retrieve and process the stored output. Hardware engines may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented engines that operate to perform one or more operations or functions described herein. As used herein, "processor-implemented engine" refers to a hardware engine implemented using one or more processors.

Similarly, the methods described herein may be at least partially processor-implemented, with a particular processor or processors being an example of hardware. For example, at least some of the operations of a method may be performed by one or more processors or processor-implemented engines. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an Application Program Interface (API)).

The performance of certain of the operations may be distributed among the processors, not only residing within a single machine, but deployed across a number of machines.

In some example embodiments, the processors or processor-implemented engines may be located in a single geographic location (e.g., within a home environment, an office environment, or a server farm). In other example embodiments, the processors or processor-implemented engines may be distributed across a number of geographic locations.

Language

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the subject matter has been described with reference to specific example embodiments, various modifications and changes may be made to these embodiments without departing from the broader scope of embodiments of the present disclosure. Such embodiments of the subject matter may be referred to herein, individually or collectively, by the term "invention" merely for convenience and without intending to voluntarily limit the scope of this application to any single disclosure or concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

It will be appreciated that an "engine," "system," "data store," and/or "database" may comprise software, hardware, firmware, and/or circuitry. In one example, one or more software programs comprising instructions capable of being executable by a processor may perform one or more of the functions of the engines, data stores, databases, or systems described herein. In another example, circuitry may perform the same or similar functions. Alternative embodiments may comprise more, less, or functionally equivalent engines, systems, data stores, or databases, and still be within the scope of present embodiments. For example, the functionality of the various systems, engines, data stores, and/or databases may be combined or divided differently.

The data stores described herein may be any suitable structure (e.g., an active database, a relational database, a self-referential database, a table, a matrix, an array, a flat file, a documented-oriented storage system, a non-relational No-SQL system, and the like), and may be cloud-based or otherwise.

As used herein, the term "or" may be construed in either an inclusive or exclusive sense. Moreover, plural instances may be provided for resources, operations, or structures described herein as a single instance. Additionally, boundaries between various resources, operations, engines, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Although the invention has been described in detail for the purpose of illustration based on what is currently considered to be the most practical and preferred implementations, it is to be understood that such detail is solely for that purpose and that the invention is not limited to the disclosed implementations, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A system comprising:

one or more processors; and a memory storing instructions that, when executed by the one or more processors, cause the system to perform operations comprising:

identifying a selection of a cabin monitoring option for a vehicle;

determining that the selection of the cabin monitoring option is a selection, by a first passenger of the vehicle, to enable an interior monitoring of the vehicle; and responsive to the selection to enable the interior monitoring of the vehicle, controlling one or more sensors to monitor an interior of the vehicle, wherein the selection to enable the interior monitoring of the vehicle overrides a prior user selection to disable the interior monitoring of the vehicle, and wherein the cabin monitoring option is provided to the first passenger responsive to at least one of the first passenger approaching or entering the vehicle or a second passenger approaching or entering the vehicle.

2. The system of claim 1, wherein the interior monitoring of the vehicle is disabled responsive to the first passenger or the second passenger exiting the vehicle.

3. The system of claim 1, wherein the first passenger is present in the vehicle and the interior monitoring of the vehicle is automatically enabled for the first passenger responsive to the second passenger approaching or entering the vehicle, or wherein a third passenger is present in the vehicle and the interior monitoring of the vehicle is automatically enabled for the first passenger responsive to the first passenger approaching or entering the vehicle.

4. The system of claim 1, wherein the one or more sensors include an image sensor or a sound sensor.

5. The system of claim 1, wherein the cabin monitoring option is provided via a mobile device of the first passenger.

6. The system of claim 1, wherein the cabin monitoring option is provided via one or more controls on a door of the vehicle.

7. The system of claim 1, wherein the cabin monitoring option is provided via one or more controls on a seatbelt system of the vehicle.

8. A method implemented by a computing system including one or more processors and storage media storing machine-readable instructions, wherein the method is performed using the one or more processors, the method comprising:

identifying a selection of a cabin monitoring option for a vehicle;

determining that the selection of the cabin monitoring option is a selection, by a first passenger of the vehicle, to enable an interior monitoring of the vehicle; and responsive to the selection to enable the interior monitoring of the vehicle, controlling one or more sensors to monitor an interior of the vehicle, wherein the selection to enable the interior monitoring of the vehicle overrides a prior user selection to disable the interior monitoring of the vehicle, and wherein the cabin monitoring option is provided to the first passenger responsive to at least one of the first passenger approaching or entering the vehicle or a second passenger approaching or entering the vehicle.

9. The method of claim 8, wherein the interior monitoring of the vehicle is disabled responsive to the first passenger or the second passenger exiting the vehicle.

10. The method of claim 8, wherein the first passenger is present in the vehicle and the interior monitoring of the vehicle is automatically enabled for the first passenger responsive to the second passenger approaching or entering the vehicle, or wherein a third passenger is present in the vehicle and the interior monitoring of the vehicle is automatically enabled for the first passenger responsive to the first passenger approaching or entering the vehicle.

11. The method of claim 8, wherein the one or more sensors include an image sensor or a sound sensor.

12. The method of claim 8, wherein the cabin monitoring option is provided via a mobile device of the first passenger.

13. The method of claim 8, wherein the cabin monitoring option is provided via one or more controls on a door of the vehicle.

14. The method of claim 8, wherein the cabin monitoring option is provided via one or more controls on a seatbelt system of the vehicle.

15. A non-transitory computer readable medium comprising instructions that, when executed by one or more processors, cause the one or more processors to perform:

identifying a selection of a cabin monitoring option for a vehicle;

determining that the selection of the cabin monitoring option is a selection, by a first passenger of the vehicle, to enable an interior monitoring of the vehicle; and responsive to the selection to enable the interior monitoring of the vehicle, controlling one or more sensors to monitor an interior of the vehicle, wherein the selection to enable the interior monitoring of the vehicle overrides a prior user selection to disable the interior monitoring of the vehicle, and wherein the cabin monitoring option is provided to the first passenger responsive to at least one of the first passenger approaching or entering the vehicle or a second passenger approaching or entering the vehicle.

16. The system of claim 1, wherein execution of the instructions by the one or more processors further causes the system to perform:

providing, via an output device of the vehicle, a visual or audible indication as to whether the interior monitoring of the vehicle is enabled or disabled.

17. The method of claim 8, further comprising:

providing, via an output device of the vehicle, a visual or audible indication as to whether the interior monitoring of the vehicle is enabled or disabled.

18. The non-transitory computer readable medium of claim 15, wherein the instructions, when executed by the or more processors, further cause the one or more processors to perform:

providing, via an output device of the vehicle, a visual or audible indication as to whether the interior monitoring of the vehicle is enabled or disabled.

19. The system of claim 1, wherein the existing passenger is a first existing passenger, and wherein execution of the instructions by the one or more processors further causes the system to perform:

determining that the selection, by the first existing passenger, to enable the interior monitoring of the vehicle presents a conflict with one or more other selections, by one or more other existing passengers, to disable the interior monitoring of the vehicle;

determining that one or more criteria for resolving the conflict in favor of enabling the interior monitoring of the vehicle are satisfied; and enabling the interior monitoring of the vehicle, wherein responsive to enabling the interior monitoring of the vehicle, the one or more sensors are controlled to monitor the interior of the vehicle.

20. The system of claim 1, wherein the one or more criteria for resolving the conflict in favor of enabling the interior monitoring of the vehicle comprise at least one of: i) presence of at least the selection to enable the interior monitoring of the vehicle by the first existing passenger regardless of a number of the one or more other selections to disable the interior monitoring of the vehicle or ii) a number of one or more selections to enable the interior monitoring of the vehicle being at least as great as a number of the one or more selection to disable the interior monitoring of the vehicle.

* * * * *